US005078054A

United States Patent [19]

Ashok et al.

[11] Patent Number: 5,078,054

[45] Date of Patent: Jan. 7, 1992

[54] FRANGIBLE PROJECTILE

[75] Inventors: Sankaranarayanan Ashok, Bethany; Julius C. Fister, Hamden, both of Conn.

[73] Assignee: Olin Corporation, Cheshire, Conn.

[21] Appl. No.: 322,953

[22] Filed: Mar. 14, 1989

[51] Int. Cl.[5] ..... F42B 10/00; F42B 12/00; F42B 14/00

[52] U.S. Cl. ..... 102/517; 102/524; 102/506; 86/1.1

[58] Field of Search ..... 86/1.1; 102/506, 520, 102/524, 501, 517, 398

[56] References Cited

U.S. PATENT DOCUMENTS

| | | | |
|---|---|---|---|
| 1,582,673 | 4/1926 | Fahrenwald et al. | 102/524 |
| 2,841,688 | 7/1958 | Andreassen et al. | 102/524 |
| 3,979,234 | 9/1976 | Northcutt, Jr. et al. | 75/225 |
| 4,165,692 | 8/1979 | Dufort | 102/398 |
| 4,362,563 | 12/1982 | Stadler et al. | 419/5 |
| 4,378,256 | 3/1983 | Watson-Adams | 102/524 |
| 4,503,776 | 3/1985 | Nussbaum et al. | 102/496 |
| 4,592,283 | 6/1986 | Hellner et al. | 102/493 |
| 4,603,637 | 8/1986 | Snide et al. | 102/529 |
| 4,665,828 | 5/1987 | Auer | 102/519 |
| 4,768,441 | 9/1988 | Theis | 102/517 |

*Primary Examiner*—Howard J. Locker
*Attorney, Agent, or Firm*—H. Samuel Kieser

[57] ABSTRACT

A frangible projectile made from powdered metals comprising a body of either iron and carbon, or of iron and alumina. The powdered metals are compacted, sintered, and cooled.

4 Claims, 1 Drawing Sheet

FRANGIBLE PROJECTILE

This invention relates to a frangible projectile, and more particularly, this invention relates to a frangible training projectile that breaks up upon impact with the target or the ground.

Target practice, particularly aircraft gunnery practice, requires an inexpensive form of ammunition which accurately simulates the ballistic characteristics of the normal load used in hostile action. However, some practice projectiles tend to ricochet on impact. This may result in damage to the aircraft and increases the safe area required over the firing range and severely limits locations at which such activity can be performed. Accordingly, work has been done to provide frangible projectiles which will fragment on impact. U.S. Pat. Nos. 4,108,084, 4,165,691 and 4,603,637 are examples of such frangible projectiles which have been designed to reduce ricochet upon impact.

It is noted that in all of the above patents, the projectiles disclosed are compound projectiles. That is, made from at least two or more separate components. In cases where the projectile has been fabricated from a single component, problems have been experienced in swaging the iron rotating band into place in that the projectile would frequently by crack.

According to the present invention, a frangible projectile is provided having the ability to survive a gun launch and remain structurally sound during in-flight projectory, as well as having the necessary frangibility characteristics on impact with the target.

The objects and advantages of the present invention may be achieved through the provision of a projectile comprising a body formed from iron and a material selected from the group consisting of carbon, alumina and mixtures thereof.

Figure 1:
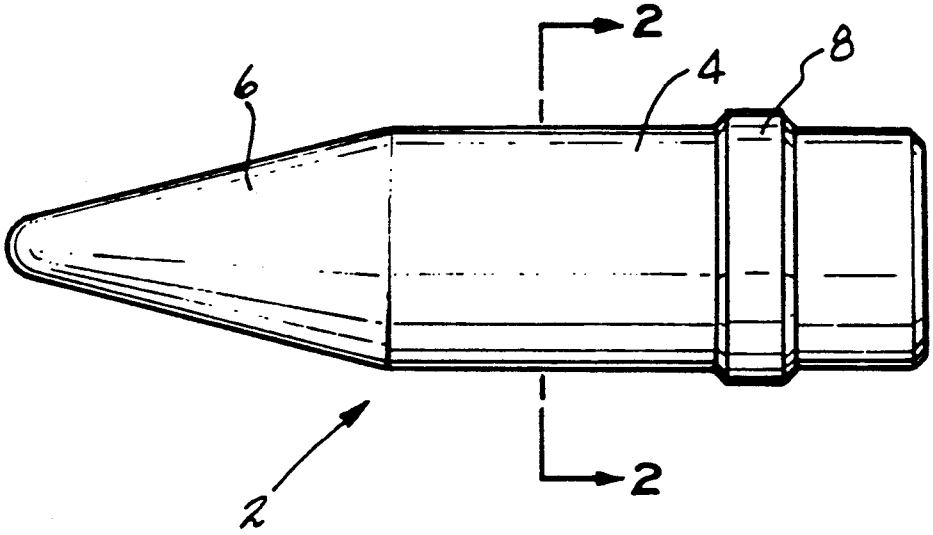
Figure 2:
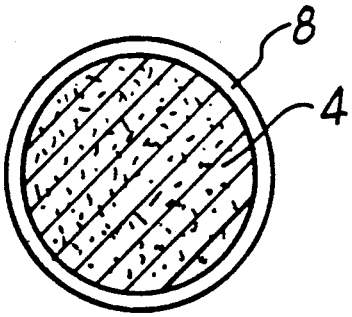

Such a projectile may be made by compacting a mixture of powdered metals comprising iron and a material selected from the group consisting of carbon, alumina and mixtures thereof into a body, sintering said compacted body, and cooling said sintered body. These and other objects and advantages of the present invention will become more apparent by reference to the following description taken in conjunction with the accompanying drawings in which:

FIG. 1 is a side view of a frangible projectile according to the invention; and FIG. 2 is a cross sectional view taken along the lines 2—2 of FIG. 1.

Referring to the drawings, FIG. 1 shows a projectile 2 made in accordance with the present invention. The projectile 2 generally comprises a body portion 4 and a forward ogival head portion 6. The configuration of the projectile should be as close as possible to the actual round that it is to simulate. A rotating band 8 is provided about the body portion 4 as shown in FIG. 1.

In accordance with the present invention, the projectile 2, excluding the rotating band 8, is fabricated in one piece from a mixture of powdered metals. The composition may be a mixture of iron and carbon or iron and alumina. In the case of iron and carbon, the carbon may comprise from about 2 to about 5% by weight of the mixture. The preferred form of carbon is graphite. In the case where an iron and alumina mixture is used, the alumina, $Al_2O_3$, may constitute from about 3.0 to about 7.0% by weight.

The metal powders are mixed together homogeneously and then compacted in the appropriate shape by any suitable compacting method such as cold compaction or isostatic pressing. Isostatic pressing in preferred in this case as it is easier to obtain the final shape.

After compacting, the projectile may be subjected to a thermal treatment which may include sintering at a temperature of from about 900° C. to about 1100° C. for about 15 minutes to about 24 hours, and preferably from about 15 minutes to about 2 hours. After the thermal treatment, the projectile may be cooled. This may be by quenching in water, or air cooling. Air cooling is preferred.

The rotating band 8 may be of soft iron and may be attached to the body 4 by any suitable method as by silver brazing or swaging. Brazing is preferred.

Table 1 sets forth the composition and the thermal treatment for various materials tested. The external shape of all the rounds consisted of a cylindrical slug having the standard soft iron rotating band attached to it by means of a continuous silver solder braze. The projectiles were loaded in a standard 25 mm Bushmaster cartridge case provided with Ball Powder propellant. The test consisted of firing each projectile from a 25 mm barrel into a 1 ⅜ in. thick steel plate inclined at a 45° angle and spaced 225 ft. from the barrel muzzle.

TABLE 1

| Code | SYSTEM | THERMAL TREATMENT |
|---|---|---|
| A | Fe - 4½% Carbon | 1100° C. × 2 hours/Air Cooled |
| B | Fe - 4½% Carbon | 1100° C. × 15 minutes/Water Quenched |
| C | Fe - 2½% Carbon | 1100° C. × 2 hours/Air Cooled |
| D | Fe - 2½% Carbon | 1100° C. × 15 minutes/Water Quenched |
| E | Fe - 5.2% $Al_2O_3$ | 900° C. × 2 hours/Air Cooled |
| F | Fe - 5.2% $Al_2O_3$ | 900° C. × 30 minutes/Air Cooled |
| G | Fe - 2½% Carbon | 900° C. × 30 minutes/Air Cooled |
| H | Fe - 4½% Carbon | 900° C. × 30 minutes/Air Cooled |

Table 2 sets forth the size and quantity of the fragments recovered in connection with each of the rounds and an explanation where necessary.

TABLE 2

| Round Number | FRAGMENT RECOVERY - SIZE AND QUANTITY 0-.1 g | .11-.5 g | .51-1.0 g | 1.01-2 g | 2.01-5 g | 5 g | Comments |
|---|---|---|---|---|---|---|---|
| A-1 | — | — | — | — | — | — | Inadequate fragment recovery material. |
| A-2 | 1 | 3 | — | — | — | — | Inadequate fragment recovery material. |
| B-1 | — | — | — | — | — | — | No fragments Recovered. |
| B-2 | 7 | 8 | 5 | 2 | 1 | 0 | |
| C-1 | 7 | 24 | 12 | 4 | 0 | 0 | |
| C-2 | 1 | 20 | 11 | 6 | 2 | 0 | |
| D-1 | 6 | 24 | 14 | 6 | 4 | 0 | |
| D-2 | 7 | 31 | 11 | 4 | 0 | 0 | |
| E-1 | 27 | 19 | 0 | 0 | 0 | 0 | |
| E-2 | 6 | 9 | 0 | 0 | 0 | 0 | |
| F-1 | 12 | 1 | 0 | 0 | 0 | 0 | |
| G-1 | 5 | 12 | 3 | 0 | 0 | 0 | |
| G-2 | 17 | 5 | 0 | 0 | 0 | 0 | |
| H-1 | — | — | — | — | — | — | Inadequate fragment recovery material. |
| H-2 | 5 | 0 | 1 | — | — | — | |

As indicated by Table 2, the materials tested appeared to have good frangibility characteristics; i.e., individual fragments less than 5 grams, and the majority of materials exhibited good projectile integrity. Based upon such tests, it would appear that the preferred compositions are iron with 5.2% by weight alumina which has been sintered at 900° C. for 2 hours and then air cooled. Other preferred compositions include iron with 2.5% by weight carbon sintered at 900° C. for 30 minutes and air cooled and iron with 4.5% weight by carbon which has been sintered at 900° C. for 30 minutes and then air cooled.

While reference has been made above to specific embodiments of the present invention, various alternatives, modifications and variations will be apparent to those skilled in the art in light of the foregoing specification. Accordingly, it is intended to embrace all alternatives, modifications and variations as fall within the spirit and broad scope of the appended claims.

What is claimed:

1. A frangible projectile comprising a body having a predetermined ballistic design, said body being formed from iron and alumina said alumina being present in the amount of from about 3 to about 7% by weight.

2. The projectile of claim 1 further including a rotating band attached to said body.

3. The projectile of claim 2 wherein said rotating band is iron and is brazed to said body.

4. The projectile of claim 2 wherein said rotating band is iron and is swaged on said body.

* * * * *